US009474951B2

(12) United States Patent
Chuang

(10) Patent No.: US 9,474,951 B2
(45) Date of Patent: Oct. 25, 2016

(54) GOLF TEE STRUCTURES, ASSEMBLIES, AND SYSTEMS WITH IMPROVED ACCURACY

(71) Applicant: William Chuang, Pittsburgh, PA (US)

(72) Inventor: William Chuang, Pittsburgh, PA (US)

( * ) Notice: Subject to any disclaimer, the term of this patent is extended or adjusted under 35 U.S.C. 154(b) by 0 days.

(21) Appl. No.: 14/960,377

(22) Filed: Dec. 5, 2015

(65) Prior Publication Data

US 2016/0206936 A1 Jul. 21, 2016

Related U.S. Application Data

(60) Provisional application No. 62/105,968, filed on Jan. 21, 2015.

(51) Int. Cl.
*A63B 57/00* (2015.01)

(52) U.S. Cl.
CPC ..... *A63B 57/19* (2015.10)

(58) Field of Classification Search
CPC ..... A63B 57/10–57/19; A63B 69/36; A63B 69/3623; A63B 2069/0008
USPC ..... D21/717–719
See application file for complete search history.

(56) References Cited

U.S. PATENT DOCUMENTS 1,570,743 A * 1/1926 Hollis ..... A63B 57/10 473/268
2,033,269 A * 3/1936 Williams ..... A63B 57/10 473/257
2,558,382 A 6/1951 Previdi
3,161,411 A * 12/1964 Cockburn ..... A63B 57/10 473/279
3,288,470 A * 11/1966 Post ..... A63B 57/10 473/278
3,406,977 A 10/1968 Voelkerding
3,473,812 A * 10/1969 Pelzmann ..... A63B 57/10 473/278
3,506,263 A * 4/1970 Arrington ..... A63B 57/10 473/278
3,633,917 A 1/1972 Anderson
3,749,409 A * 7/1973 Redmon ..... A63B 57/10 473/261
3,947,027 A * 3/1976 Brown ..... A63B 57/10 473/278
4,367,879 A * 1/1983 Messer ..... A63B 57/10 473/278
4,526,369 A 7/1985 Phelps
5,054,786 A 10/1991 Solomon
5,193,803 A * 3/1993 Flick, III ..... A63B 57/10 473/392
D352,080 S * 11/1994 Boyer ..... D21/717
5,645,498 A 7/1997 Cretella
5,738,598 A * 4/1998 Wu ..... A63B 57/10 473/392
5,984,808 A * 11/1999 Fleischer ..... A63B 57/10 473/388
6,344,003 B1 * 2/2002 Choung ..... A63B 57/10 473/387
6,428,429 B1 8/2002 Lee
7,140,982 B2 11/2006 Park
7,699,721 B2 4/2010 Godlove
8,469,838 B2 6/2013 Breton (Continued)

*Primary Examiner* — Steven Wong
(74) *Attorney, Agent, or Firm* — Fantastic IP Consulting; Eduardo E. Drake

(57) ABSTRACT

Golf is waning in popularity partly because of the difficulty of becoming a good player. A key aspect of this difficulty is in using a golf club to drive a ball in a desired direction. To make this easier, the present inventor devised, among other things, a directional golf tee structure that enables players to select a drive direction by orienting the golf tee in the desired direction and then using a golf club to strike a portion of the golf tee instead of the ball. The struck portion of the golf tee filters out or reduces the effect of golf club swing errors, thereby promoting greater accuracy. In some embodiments, the tees are configured for specific loft angles, fade, and/or draw attributes, not only providing a variety of play and training options, but ultimately making golf easier and more enjoyable for players of all skill levels.

10 Claims, 7 Drawing Sheets

(56) References Cited

U.S. PATENT DOCUMENTS

| | | | | |
|---|---|---|---|---|
| 8,512,168 | B2 | 8/2013 | Hanley | |
| 2001/0029212 | A1* | 10/2001 | Dovigi | A63B 57/10 473/387 |
| 2002/0193183 | A1 | 12/2002 | Aikman | |
| 2003/0148830 | A1* | 8/2003 | Hsiao | A63B 57/10 473/387 |
| 2006/0287135 | A1* | 12/2006 | Pommereau | A63B 57/10 473/387 |
| 2010/0160088 | A1* | 6/2010 | Tan | A63B 57/10 473/390 |
| 2013/0079180 | A1* | 3/2013 | Sinanis | A63B 57/0037 473/386 |
| 2013/0267350 | A1 | 10/2013 | Koncelik, Jr. et al. | |
| 2014/0309057 | A1* | 10/2014 | Reams | A63B 57/0018 473/387 |

* cited by examiner 600
620
621D
621
626
612A
631B
130
612D
630
613
631A 620
621
622
130
131
626
612A
612C
611
610
611B
631A
630
612
612B
613
611A 620
621C
621B
621A
610
130
621D
612
626
612B
613
611B

GOLF TEE STRUCTURES, ASSEMBLIES, AND SYSTEMS WITH IMPROVED ACCURACY

RELATED APPLICATION

The present application claims priority to U.S. Provisional Patent Application 62/105,968, which was filed Jan. 21, 2015 and which is incorporated herein by reference.

COPYRIGHT NOTICE AND PERMISSION

A portion of this patent document contains material subject to copyright protection. The copyright owner has no objection to the facsimile reproduction by anyone of the patent document or the patent disclosure, as it appears in the patent and trademark office patent files or records, but otherwise reserves all copyrights whatsoever. The following notice applies to this document: Copyright © 2015, WILLIAM CHUANG.

TECHNICAL FIELD

Various embodiments of the invention relate generally to golf tees and related methods of supporting and striking a golf ball.

BACKGROUND

Millions of people around the world enjoy the game of golf. In the U.S., the game is enjoyed by 25 million Americans who annually play over 450 million rounds at more than 15,000 facilities. It is a nearly $70 billion industry, supporting two million jobs and $55.6 billion in annual wage income.

Despite this success, there are many in the industry who are concerned about the future of the golf industry, pointing to an estimated 20% reduction in overall participation over the past decade or so, particularly among younger players. Some attribute the reduction to the length of time that it takes to play a round of golf, the cost of playing, and the difficulty of playing.

In response, the industry is experimenting with adding 3- and 6-hole options to the 9- and 18-hole options, and allowing non-traditional games, such as "hack golf" which replaces the traditional 4.25-inch-diameter hole with a 15-inch-diameter one, and "foot golf" which uses a 21-inch-diameter hole and replaces golf balls and clubs with soccer balls and kicking players. There are also some reports of creating alternative rules to make the traditional game more enjoyable for recreational players.

Even with all this, the present inventor has recognized that there is still the problem of difficulty, specifically the problem of becoming proficient at hitting a golf ball with a golf club with consistent accuracy, an activity widely regarded as one of the most challenging in all of sport. Moreover, the difficulty is most visible when teeing off at each hole, that is, hitting the ball off a tee in full view of your competing players, exposing players, particularly beginner players, to considerable risk of embarrassment and/or frustration from mishit balls. Although technology improvements to golf balls and golf clubs have made it easier for some players to hit longer and somewhat straighter, the continued decline in participation show that these improvements have not been enough to reverse current trends.

Accordingly, the present inventor has identified an unmet need to make golf easier to play.

SUMMARY

To address one or more of these and/or other needs or problems, the present inventor devised, among other things, one or more exemplary systems, kits, methods, devices, assemblies, and/or components related to golf tees, particularly golf tees that provide increased directional accuracy for golfers.

In one exemplary embodiment, the invention takes the form of a directional golf tee structure that can ensure a desired ball flight direction for a wide range of club head striking errors and still yield the desired ball flight direction. To achieve this, one exemplary structure includes a golf ball support structure and a spherical strike body. The support structure is configured to position a rear portion of the golf ball in tangential contact with one side of the spherical strike body. An opposite side of the strike body is positioned to receive the force of a striking golf club head. When struck by the golf club head, the spherical strike body transfers the portion of the force in alignment with the desired ball flight direction to the golf ball and inhibits transfer of portions of the strike force that are misaligned with the desired direction. In other words, the strike body effectively filters out or reduces the effect of golf club swing errors, thereby promoting greater directional accuracy. Over time, as players learn to increase distance of their drives using the directional tee, their swing mechanics may improve. In some embodiments, the tees are preconfigured or adjustable for specific loft angles, fade, and draw attributes. Tees incorporating principles of the present invention not only provide a variety of play and training options, but ultimately promise to make golf easier and more enjoyable for players of all skill levels.

BRIEF DESCRIPTION OF THE DRAWINGS

Various embodiments are described herein with reference to the following attached figures (Figs). These figures are annotated with reference numbers for various features and components, and these numbers are used in the following description as a teaching aid, with like numbers referring to the same or similar features and components.

DETAILED DESCRIPTION OF THE EXEMPLARY EMBODIMENT(S)

This document, which incorporates drawings and claims, describes one or more specific embodiments of one or more inventions. These embodiments, offered not to limit but only to exemplify and teach the invention, are shown and described in sufficient detail to enable those skilled in the art to implement or practice the invention(s). Thus, where appropriate to avoid obscuring the invention(s), the description may omit certain information known to those of skill in the art.

Figure 1B:
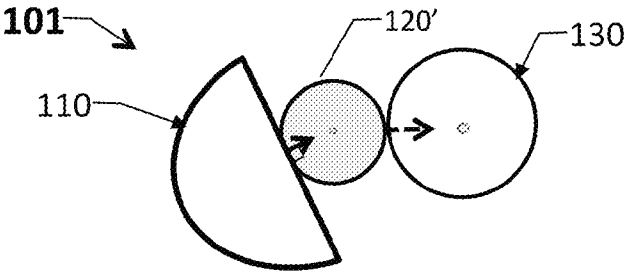
FIG. 1B is a schematic top view of a golf assembly 101 which corresponds to one or more embodiments of the present invention.
Figure 1C:
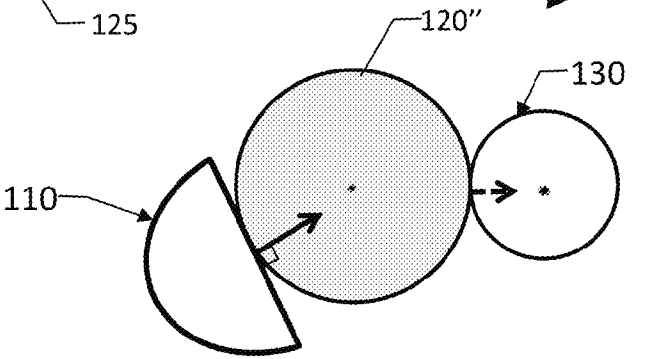
FIG. 1C is a schematic top view of a golf assembly 102 which corresponds to one or more embodiments of the present invention.
Figure 1A:
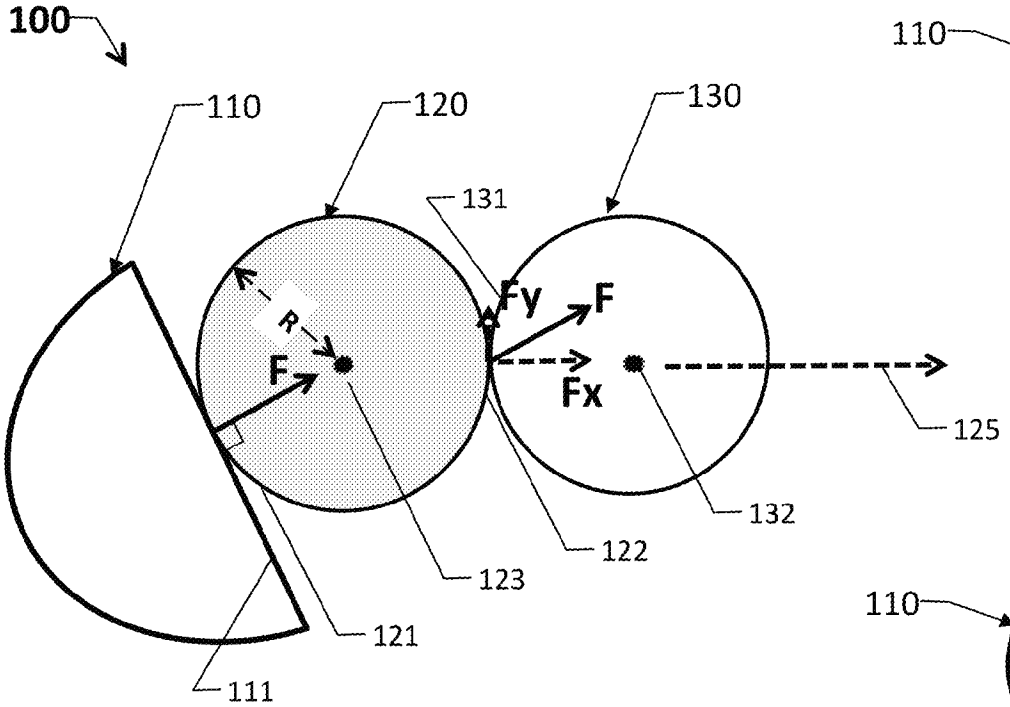
FIG. 1A is a schematic top view of a golf assembly 100 which corresponds to one or more embodiments of the present invention.

FIG. 1, a simplified two-dimensional top view, shows a golf assembly 100, including a golf club head 110, a directional golf tee structure 120, and a golf ball 130.

Golf club head 110, which is generally representative of any golf club head, for example, a driver, iron, or putter, has a club head face 111 applying a force vector F of an arbitrary magnitude and direction F to directional golf tee structure 120.

Golf tee structure 120 includes a club strike surface 121, a golf ball strike surface 122, a central reference point 123, and a ball support axis 124 (not visible in this view). Club strike surface 121 is spherically convex: that is, bowed outward uniformly from the central reference point 123 by a distance R, the radius of a sphere. (In some embodiments, the distance R may vary with position on the strike surface to define non-spherical surfaces) Golf ball strike surface 122, which is also spherically convex and substantially fixed in position relative to club strike surface 121, is positioned such that a portion of it is in an approximate tangential contact relationship with an adjacent strike surface 131 of golf ball 130.

Golf ball 130 also has a central reference point 132, and is supported via golf tee structure 120 such that center 132 and golf ball strike surface 122 define a desired flight line direction 125 of golf ball 130.

In operation, golf assembly 100 operates as follows. Club head face 111 strikes club strike surface 121 in an approximate tangential manner, imparting a radial force vector F to the spherical convex surface. In the plane of the figure, force vector F is transferred radially from the point of contact on the club strike surface to center 123 and appears as parallel force vectors along ball strike surface 122, with the force vector at each point of surface 122, including the point of contact of ball strike surface 122 with strike surface 131 of golf ball 130. At the point of contact of surfaces 122 and 131, which is ideally tangential, force vector F has orthogonal component vectors Fx and Fy. (The orthogonal third dimension z is ignored here for sake of simplicity.) More particularly, force vector Fx is not only parallel to the radial line segment at the point of contact to the center of the golf ball, but also to the desired flight line direction 125. With perfectly rigid, non-deforming strike surfaces, force vector Since Fx is in the direction of ball travel, and Fy is perpendicular, and since the ball contacts at only one point, Fy only serves to move the force filter away from the ball, and thus does not influence it's path. The only vector which moves the ball is Fx. In other words, in this embodiment, the convex nature of strike surfaces 121 and 122 enable golf tee structure 120 to serve as a force filter that prevents all but the most egregious club head errors from directing the golf ball away from the desired direction. Moreover, the nature of the filtering is such that the degree of club head contact error will be evident in the distance the golf ball travels, enabling users to focus on improving distance as a likely indicator of improving golf swing mechanics. In some embodiments, golf ball strike surface 122 is not convex; for example, it may be in the form of a plane or have other geometry, and still achieve a force filtering effect.

FIGS. 1B and 1C show respective alternative golf assemblies 101 and 102, both of which are functionally analogous in structure and function to golf assembly 100. Golf assembly 101 shows a golf tee structure 120' that has spherically convex strike surfaces that are smaller in radius than golf ball 130. And golf assembly 102 in FIG. 1C, shows a golf tee structure 120" with spherically convex strike surfaces that have a larger radius than that of golf ball 130. Note that in some embodiments the directional tee may use spherically convex strike surfaces that are substantially different from each other. For example, some embodiments include a spherically convex club head strike surface have a 2 R radius, a spherically convex golf ball strike surface having a 0.75 R radius, where R is the radius of the golf ball.

Figures 2A, 2B, 2C:
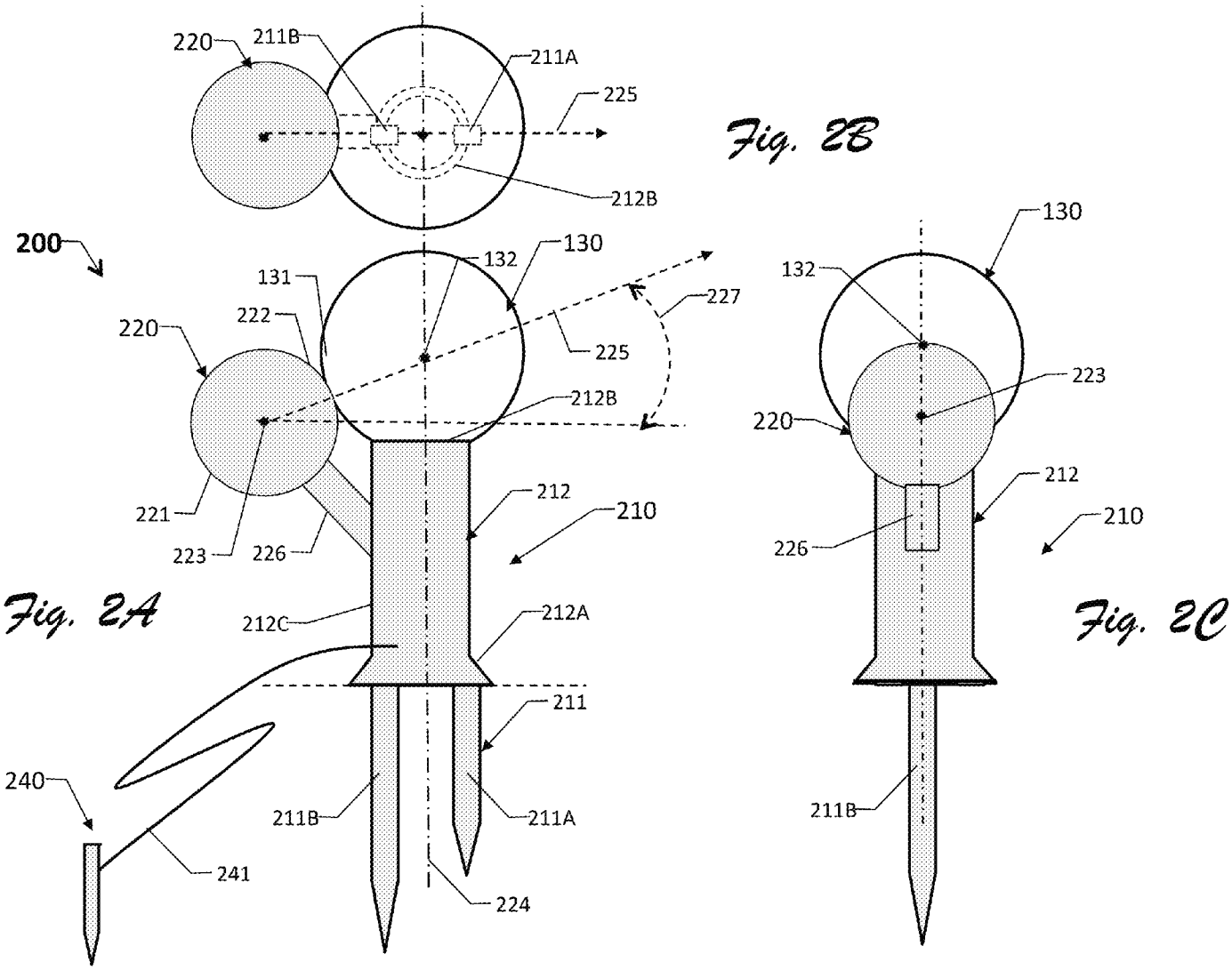
FIG. 2A is a side view of a golf tee assembly 200 which corresponds to one or more embodiments of the present invention.
FIG. 2B is a top view of golf tee assembly 200 corresponding to one or more embodiments of the present invention.
FIG. 2C is a back view of golf tee assembly 200 corresponding to one or more embodiments of the present invention.

FIGS. 2A, 2B, and 2C show an alternative directional golf tee assembly 200, which incorporates one or more aspects of golf assemblies 100, 101, and 102. In particular, golf tee structure 200 includes a stem portion 210 and a strike force filter 220, and a stake assembly 240.

Stem portion 210 includes a below-ground portion 211 and an above-ground portion 212. Below-ground portion 211 includes a front ground stake 211A and a back ground stake 211B, with stake 211A having a substantially different length, for example approximately 25% shorter, to denote its front position relative to stake 211B and to allow rotation of the golf tee structure around the axis of the back stake to a desired direction prior to insertion of the front stake into the ground. FIG. 2B shows that the stakes, or more precisely their center points, are generally collinear with desired flight line direction 225 to facilitate establishing the desired direction at the time of insertion. In some embodiments, the stakes may be unified into a single wide stake by filling in the space between them over all or part of the entire length of the shorter stake, creating a tab-like structure.

Above-ground portion 212, which takes a tubular form in the exemplary embodiment, includes a flange portion 212A at its lower end and a ball-support portion 212B at its upper end. Flange portion 212A extends outward to provide additional lateral stability to the tee structure when stakes 211A and 211B are inserted into the ground. Ball-support portion 212B includes a ringed-wall, best visible in FIG. 2B, which functions as a shallow holding cup for golf ball 130 and defines ball support axis 224. Ball-support portion 212B is inclined in some embodiments to ensure ball 130 stays in contact with ball strike surface 222. Extending from a rear sidewall portion 212C of above ground portion 212 is a support arm 226 of strike force filter 220.

Strike force filter 220 further includes a club strike surface (input) 221, a golf ball strike surface (output) 222, a central reference point 223, a desired flight line direction 225, and a loft angle 227.

Club strike surface 221 and golf ball strike surface 222, respectively similar in form and function to strike surfaces 121 and 122 in FIG. 1, are each spherically convex (defined earlier as bowed outward uniformly from a central reference point.) In some embodiments, the surfaces define opposite sides of a spherical object having a common central reference point and defining radius; in others, the spherically convex surfaces may be the same center point and different defining radii; and in yet other embodiments, the surfaces are non-spherical convex surfaces, such as ellipsoidal surfaces. Moreover, in some embodiments, it may be advantageous to laterally and/or vertically offset the central reference points of the convex surfaces. Additionally, some spherical or other objects defining the convex surfaces are partially hollowed or bored to reduce mass of the golf tee structure and/or to facilitate even cooling and thus prevent distortion of the strike force filter during injection molding. Golf ball strike surface 222, is positioned such that a portion of it is in approximate tangential contact relationship with an adjacent strike surface 131 of golf ball 130.

Desired flight line direction 225 is defined by central reference point 223 and golf ball center 132, and loft angle 227 is defined by height of golf ball center 132 relative to a horizontal plane through central reference point 223. In the exemplary embodiment, this angle is a fixed angle in the range of 0 to 90 degrees inclusive. Some embodiments may provide an angle in the range of 0-45 degrees, and still others in the range of 0 to 60 degrees.

However, in some embodiments, the angle of support arm 226 relative to vertical reference axis 224, and/or the height of the golf ball center relative to central reference 226 are adjustable. To adjust the height of the golf ball center, some embodiments include a multi-pronged plastic tube that slideably engages in an interference fit with the interior or in some cases the exterior of above-ground portion 212. The engagement surface in some instances is augmented to include grooves or ridges for a discreet incremental adjustment. Threaded arrangements are used in some embodiments. The adjustment tube includes an open end at its top to serve as a holding cup for the golf ball.

FIG. 2A also shows that in some embodiments assembly 200 further includes a stake 240 attached to upper portion 212 via a tether 241. The stake, is intended to be anchored in the ground prior to use of the golf tee structure, and the tether restricts travel of the tee structure if it dislodges after being struck by a golf club. The length of the tether can vary from as little as several inches to even 10 or more feet. Also in some embodiments the tether may be attached to lower portion 211.

Figure 3:
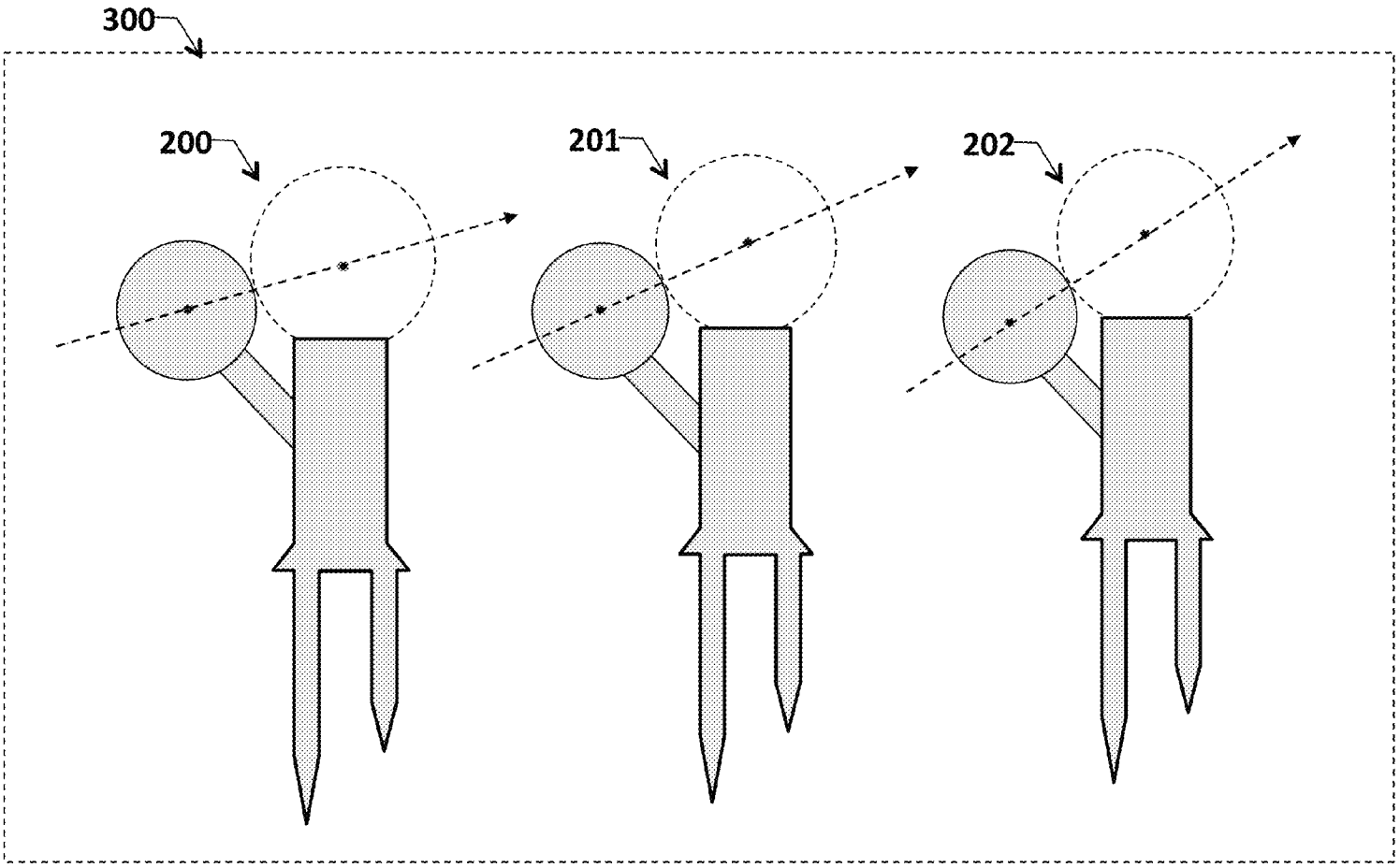
FIG. 3 is a schematic view of an exemplary kit or ensemble 300 of directional golf tee structures providing different loft angles, corresponding to one or more embodiments of the present invention.

FIG. 3 shows an exemplary golf tee kit 300. Kit 300 includes three directional golf tee structures 200, 201, and 202, which are substantially identical in form and function except for respective loft angles 227A, 227B, and 227C. In operation, a user would select among the directional tees based on loft angle to achieve a desired distance or perhaps to clear a grove of trees or other course obstacle. In the exemplary embodiment, various sets of loft angles combinations for the kit include 10, 20, and 30 degrees; 15, 25, and 45 degrees; or 25, 30, and 40 degrees. Some embodiments may include balls, and still others may include greater or lesser numbers of tee structures and balls. Still others may include codes and website links on the body of the balls, tee structures, or packaging to download an app, such as that described below.

Figure 4:
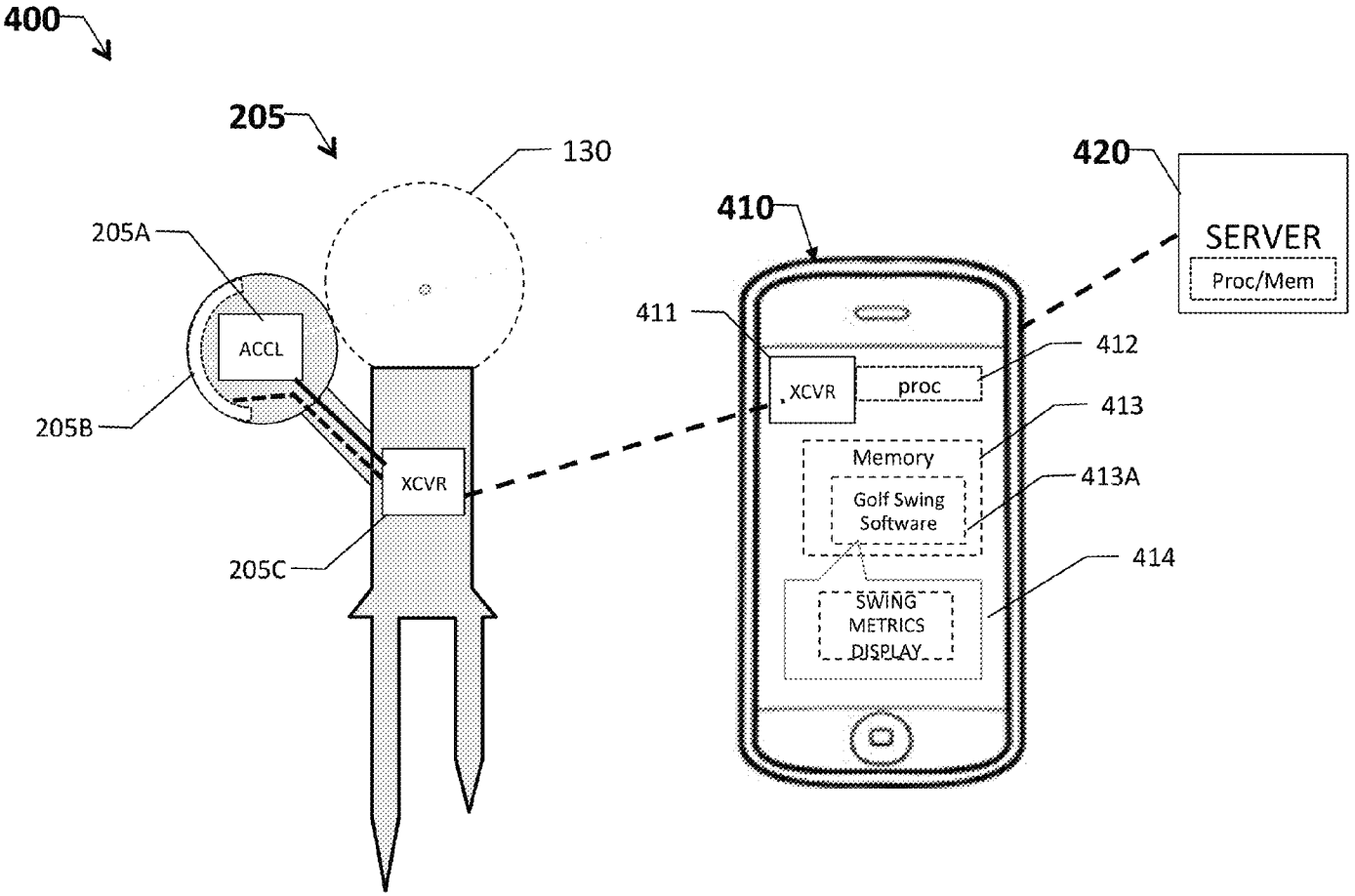
FIG. 4 is a schematic view of an exemplary golf tee sensing system 400 corresponding to one or more embodiments of the present invention.

FIG. 4 shows an exemplary golf tee sensing system 400. System 400 includes a directional golf tee 205, a smartphone 410, and a central webserver 420. Directional golf tee 205 is similar in form and function to golf tee structure 200 in FIGS. 2A, 2B, and 2C, with the addition of an accelerometer sensor 205A, a contact point sensor 205B, and a wireless transceiver 205C. Accelerometer 205A senses acceleration along three axes and contact point sensor 205B, for example, one or more piezoelectric or piezoresistive force sensors, senses the point and force of contact. Accelerometer 205A and contact point sensor 205B transmits respective electrical signals to wireless transceiver 205C. In the exemplary embodiment, wireless transceiver 205C takes the form of a Bluetooth compliant device, and communicates wirelessly to smartphone 410 (or other paired computing device such as laptop or tablet computer having a compatible wireless transceiver), such as transceiver 411. In addition to transceiver 411, smartphone 410 includes a processor 412, a memory 413, and a display 414. Memory 413 includes golf swing software module 413A which includes computer readable and executable instructions for translating accelerometer and/or contact sensor data into useful golf swing or game analysis data (for example golf swing metrics such as club head speed, angle, and direction and/or causing display of the metrics on display 414 and/or communicating the data via the internet or cellular data link to a central webserver 420. Some embodiments may include an additional sensor, for example, a photoelectric sensor underneath golf ball 130 to sense departure of the golf ball, allowing estimation of golf ball velocity based on the time of impact with the club head strike surface and the time of departure of the golf ball. Webserver 420, which includes one or more processors and machine readable storage media (memory) may include a database of swing diagnostic or tip videos that are tagged or logically associated with one or more swing metrics or metric ranges and software modules that can search and serve up one or more of the videos or other related information to the user via the smartphone or tablet, based on the received swing metric data. In some embodiments, the transceiver and accelerometer are powered via a battery, such as a button or coin cell. In still other embodiments, the battery may be charged via piezoelectric effect generated from impact of the club head with the directional golf tee.

Figure 5B:
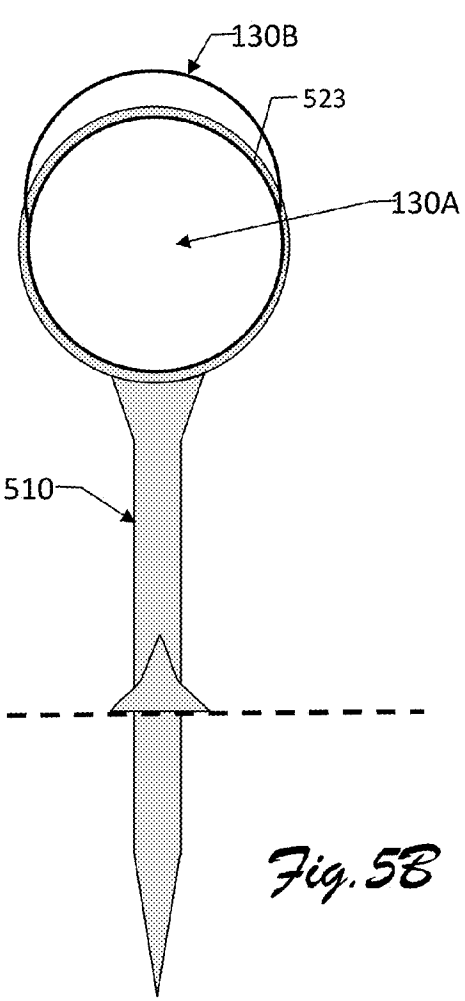
FIG. 5B is a front view of golf tee assembly 500 corresponding to one or more embodiments of the present invention.
Figure 5A:
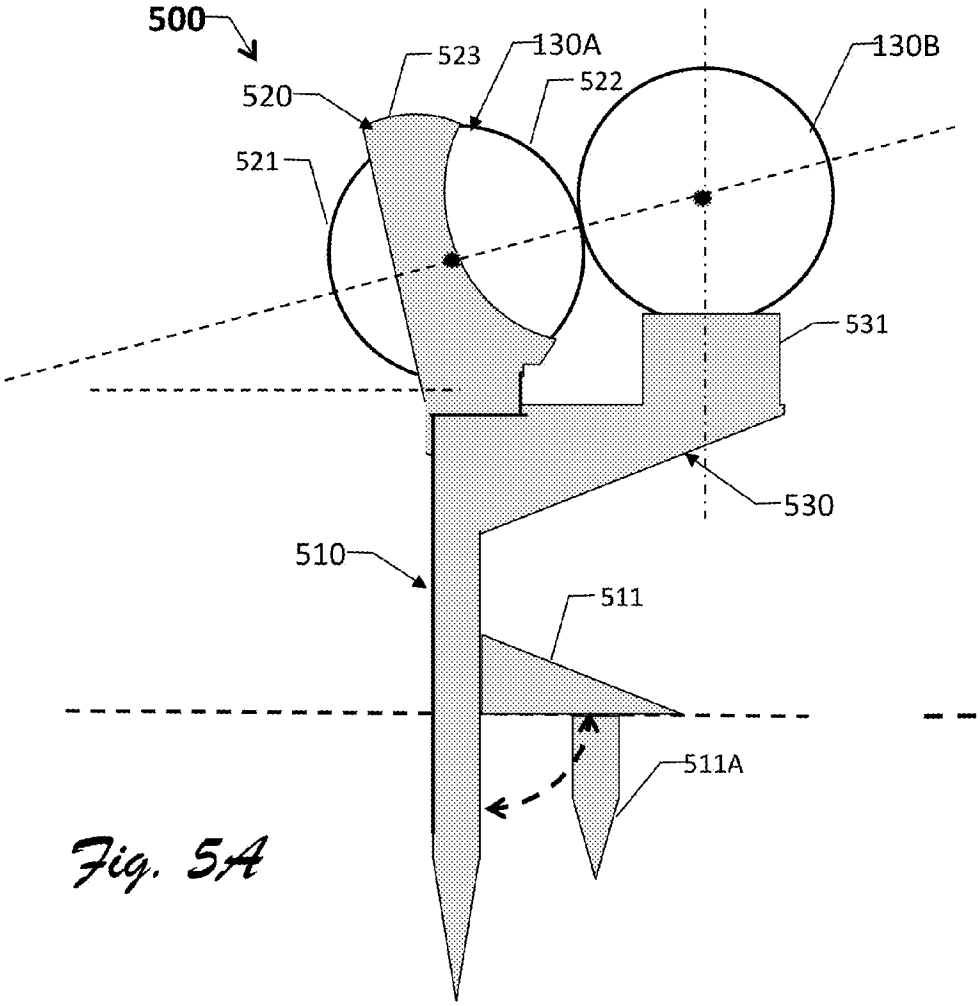
FIG. 5A is a side view of an exemplary golf tee assembly 500 which corresponds to one or more embodiments of the present invention.
Figure 6A:
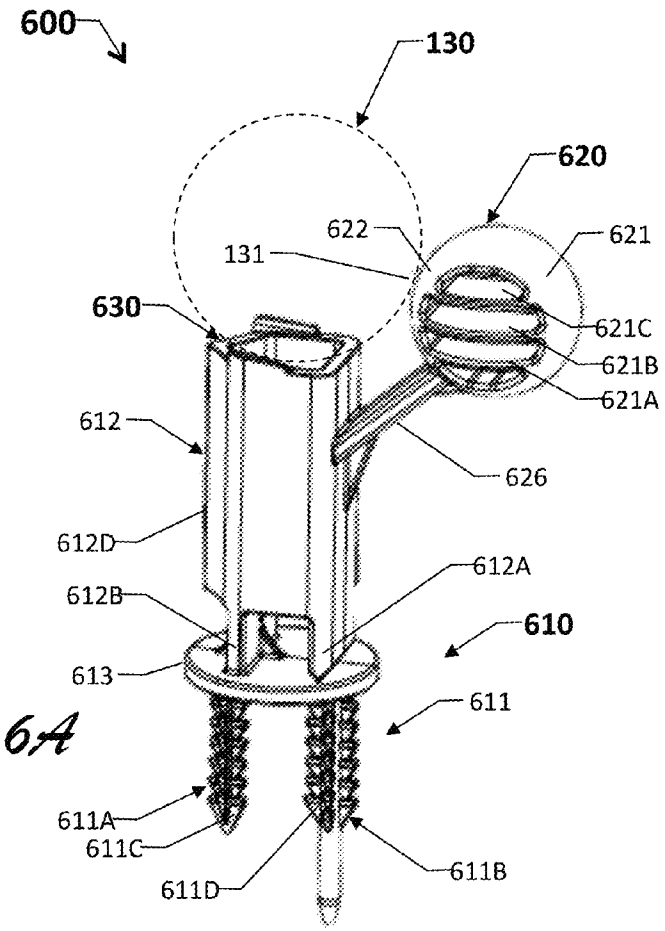
FIG. 6A is a perspective view of another exemplary golf tee assembly 600 which corresponds to one or more embodiments of the present invention.
Figures 6B, 6C, 6D:
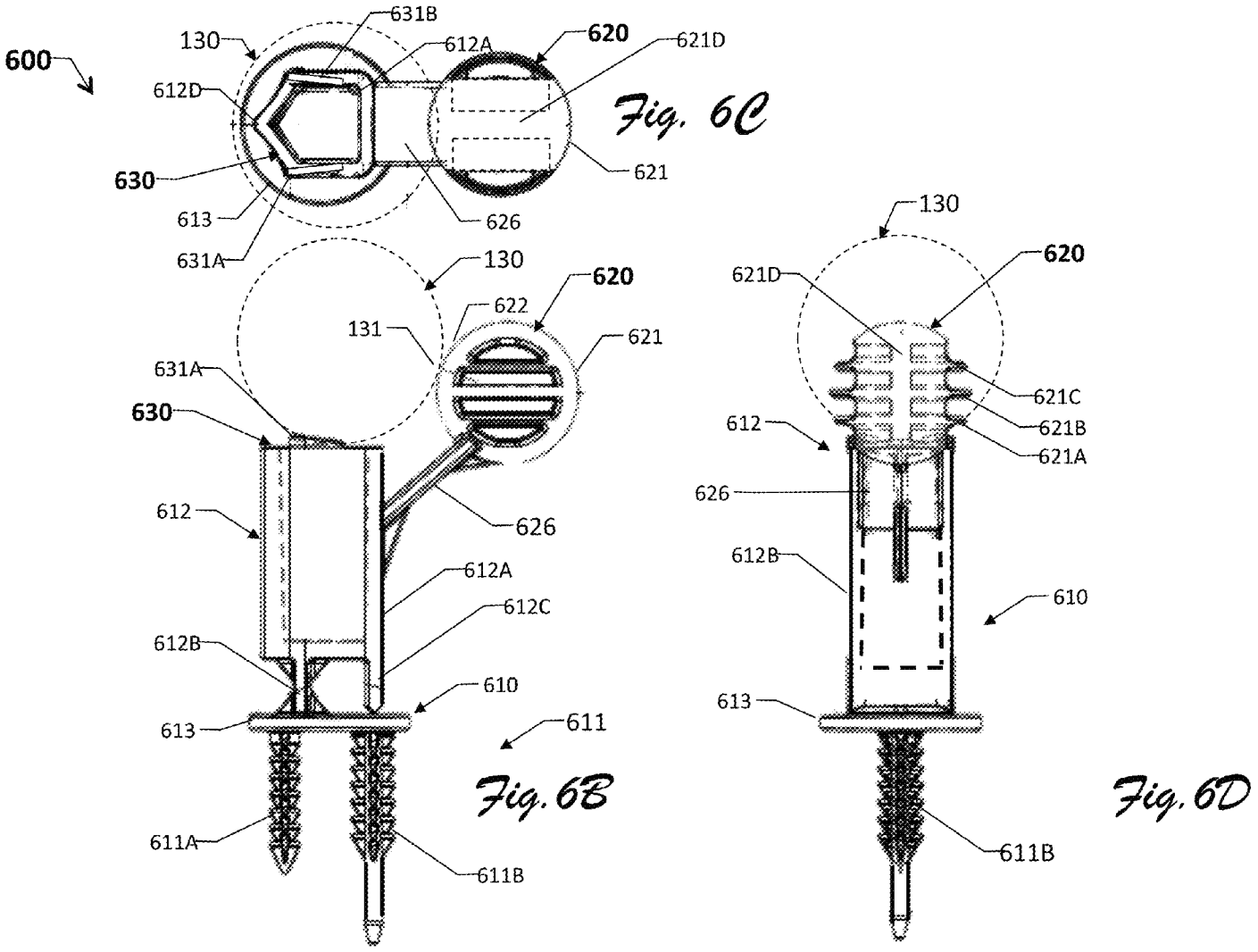
FIG. 6B is a side view of golf tee assembly 600 corresponding to one or more embodiments of the present invention.
FIG. 6C is a top view of golf tee assembly 600 corresponding to one or more embodiments of the present invention.
FIG. 6D is an end view of golf tee assembly 600 corresponding to one or more embodiments of the present invention.

FIGS. 5A and 5B show respective side and profile views of another alternative directional golf tee structure 500. Structure 500 includes a stem portion 510, a strike force filter 520, and a golf ball support portion 530. Stem portion 510 is substantially vertical and includes a limiter flange or projection 511 extending from it. Limiter flange 511 limits the ground insertion depth of stem portion 510 and also sets the flight loft angle for the tee structure relative to horizontal. In some embodiments, limiter flange 511 is pivotable to allow for adjustment of the loft angle. Also in some embodiments flange 511 includes a stake portion 511A to inhibit rotation of the golf tee structure 500 after being struck by golf club. Strike force filter 520 comprises golf ball 130A within a retaining ring 523, with the golf ball providing a club head strike surface 521 and a golf ball strike surface 522. Golf ball support portion 530 cantilevers outward from stem portion 510 and includes a cup portion 531 to support golf ball 130B in a tangential contact relationship with strike surface 522. In principle, golf tee structure 500 functions like the other golf tee structures described herein, with the tee structure being placed in the ground and pivoted to a desired direction, prior to strike force filter 520 receiving a strike force from golf club and reducing the effect of undesired components of the applied strike force, that is those components not in alignment with the desired flight direction, on the flight of golf ball 130B.

FIGS. 6A, 6B, 6C, and 6D show respective perspective, profile, top, and end views of another alternative directional golf tree structure 600, similar to golf tee structure 200 but with additional features. Structure 600 includes a stem portion 610, a strike force filter 620, and a golf ball support portion 630.

Stem portion 610 includes a below-ground portion 611 and an above-ground portion 612, and a separator flange or disk 613. Below-ground portion 611 includes a front ground stake 611A and a back ground stake 611B, including respective barbs 611C and 611D extending in front, back, left, and right directions. The barbs inhibit removal of the structure from the ground. Front ground stake 611A is approximately one inch long in the exemplary embodiment, whereas back prong 611B is approximately one-and-one-half inches long, with the lower one half inches of its length lacking any barbs to allow manual rotation of the golf tee structure to set it in the desired direction, prior to full insertion of both stakes into the ground. The two stakes also inhibit rotation of the golf tee structure when strike force filter 620, which is cantilevered off above ground portion 612 via support arm 626, is struck by a golf club head in normal operation.

Above-ground portion 612, separated from below-ground portion 611 via flange 613, includes a 5-sided tube 612A, a flex leg 612B, and a breakaway support leg 612C. 5-sided tube 612A (shown best in FIG. 6C) includes 5 sides (not separately labeled), with two of the 5 sides coming together to define a pointer structure 612D in alignment with support arm 626. Flex leg 612B is configured to flex in response to strike force applied to strike object 620, thereby reducing lateral force transferred to ground stakes 611A and 611B. Breakaway support leg 612C is provided to facilitate formation of the golf tee structure via injection molding, and breaks away from flange 613 after one or more usages of the golf tee structure. The top rim of above-ground potion 612 forms ball support portion 630, which supports and positions golf ball 130 into contact with golf ball strike surface 621 of strike force filter 620. Ball support portion 630 also includes inclined tabs or ramps 631A and 631B to guide and bias ball 130 into contact with strike force filter 620.

Strike force filter 620, which has a smaller-than-golf-ball radius in this embodiment and takes the form of a partially hollowed sphere, includes a golf club strike surface 621 and a golf ball strike surface 622. These surfaces are respectively similar in form and function to strike surfaces 121 and 122 in FIG. 1 and strike surfaces 221 and 222 in FIG. 2, are each spherically convex in this embodiment. Golf ball strike surface 222, is positioned such that a portion of it is in approximate tangential contact relationship with an adjacent strike surface 131 of golf ball 130. In this embodiment, strike force filter 620 has partially hollowed for not only aesthetic appeal and reduced mass, but also to facilitate uniform cooling of part using injection molding techniques. The exemplary hollowed structure includes three stacked horizontal disk-like fins 621A, 621B, and 621C that intersect a vertical disk-like armature 621D (shown best in FIG. 6D). This structure also ensures the desired tangential relationship between golf ball strike surface 622 and golf ball strike surface 131, while also allowing the strike force filter to effectively present a spherical convex form to a striking golf club head.

In operation, golf tee structure 600 is similar to other embodiments described herein. In particular, a user inserts the golf tee structure into a select portion of ground, first partially with its longer stake and then after rotation of the tee structure to the desired direction, then fully with the shorter stake. After insertion, the user places a golf ball, such as ball 130 onto the ball support portion 630, with the ramp tabs 631A and 631B guiding the ball into tangential contact with surface 622 of strike force filter 620. With the ball teed up in this manner and the tee directed in the desired direction, the user strikes surface 621 of strike force filter 620 with a golf club head face. The filter receives the force and transfers portions of the force in alignment with the desired flight direction to the ball, effectively shunting portions or components of the club head strike force that are misaligned with the desired direction into the ground and/or the tee structure, more generally away from the ball. Notably, flex leg 612B flexes in response to the applied club head force, as another mechanism for dissipating the misaligned portions of the club head force.

CONCLUSION

In the foregoing specification, specific exemplary embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms, such as second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed. Also, the term "exemplary" is used as an adjective herein to modify one or more nouns, such as embodiment, system, method, device, and is meant to indicate specifically that the noun is provided as a non-limiting example.

What is claimed is:

1. A golf tee structure comprising:

a golf ball support configured to support a golf ball above a selected portion of ground;

a directional indicator structure attached to the golf ball support to indicate a desired flight line direction for the golf ball; and a force filter attached to the golf ball support and having first and second opposing convex surfaces, with the first convex surface configured to receive an input force from a golf club head and the second convex surface configured to contact a portion of the golf ball and inhibit transfer of portions of the input force that are not parallel to the desired flight line direction to the golf ball, wherein the first and second opposing convex surfaces are on opposing sides of a substantially spherical object.

2. The golf tee structure of claim 1, wherein the substantially spherical object includes a set of two or more fin structures.

3. The golf tee structure of claim 1, wherein the substantially spherical object is hollow.

4. The golf tee structure of claim 1, wherein the substantially spherical object has a radius at least approximately as great as that of the golf ball.

5. The golf tee structure of claim 1, further comprising first and second ground stakes extending from the golf ball structure and configured for insertion into a selected portion of ground.

6. The golf tee structure of claim 5, further including a flex joint above the first and second ground stakes and below a surface of the golf ball support configured to contact the golf ball.

7. The golf tee structure of claim 1, further comprising a sensor configured to produce an electrical signal in response to the input force, and a wireless transceiver configured to transmit a wireless signal based on the produced electrical signal to a smart phone or a tablet computer.

8. A golf tee structure comprising:

a portion configured to support a golf ball above a selected portion of ground; and a strike body having first and second opposing convex surfaces, the first convex surface configured to receive an input force from a golf dub head and the second convex surface configured to contact a portion of the supported golf ball and transfer only a portion of the input force to the golf ball;

wherein the strike body takes the general form of a sphere having a radius at least approximately as great as that of the golf ball.

9. The golf tee structure of claim 8, wherein the first and second opposing convex surfaces are spherically convex.

10. The golf tee structure of claim 8, further comprising a sensor configured to produce an electrical signal in response to the input force received at the first convex surface, and a wireless transceiver configured to transmit a wireless signal based on the produced electrical signal to a smart phone or a tablet computer.

* * * * *